United States Patent [19]

Holmes

[11] 4,333,566

[45] Jun. 8, 1982

[54] CLOSURE STRIP

[75] Inventor: Jack H. Holmes, Cowiche, Wash.

[73] Assignee: Kwik Lok Corp., Yakima, Wash.

[21] Appl. No.: 211,572

[22] Filed: Dec. 1, 1980

[51] Int. Cl.[3] ..... B65D 85/24

[52] U.S. Cl. ..... 206/343; 206/820

[58] Field of Search ..... 206/343, 338, 390, 820; 24/30.5 R, 30.5 S; 29/413

[56] References Cited

U.S. PATENT DOCUMENTS

| | | | |
|---|---|---|---|
| 3,164,249 | 1/1965 | Paxton | 206/343 |
| 3,164,250 | 1/1965 | Paxton | 206/820 X |
| 3,270,872 | 9/1966 | Paxton | 206/343 X |
| 3,270,873 | 9/1966 | Paxton | 206/343 X |
| 4,026,413 | 5/1977 | Britt et al. | 206/343 |

*Primary Examiner*—Steven M. Pollard

*Attorney, Agent, or Firm*—Seed, Berry, Vernon & Baynham

[57] ABSTRACT

A multi-closure strip of generally flat, rigid, plastic closures which are joined in an elongated strip by sets of transversely spaced webs in which the webs have enlarged central portions terminating in reduced transverse widths at the junctures of the closures with the webs. Preferably, the central portion is symmetrically or equidistantly located lengthwise between the closures and is of a circular configuration.

4 Claims, 2 Drawing Figures

FIG. 1
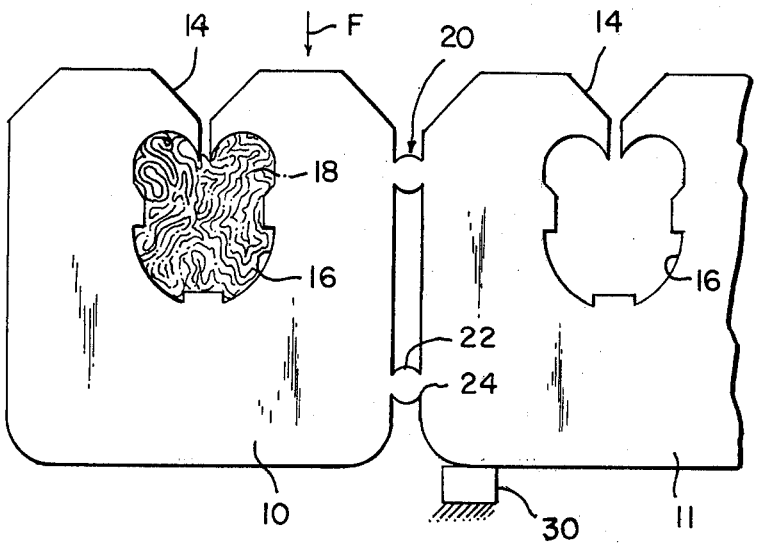
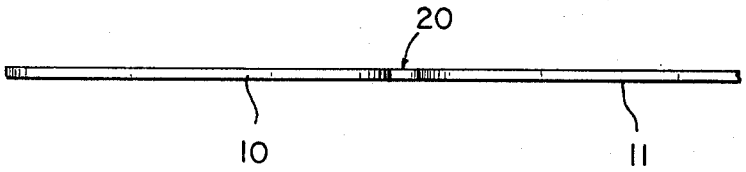
FIG. 2

CLOSURE STRIP

BACKGROUND OF THE INVENTION

1. Field of the Invention

This invention pertains to closures formed of flat plastic material for holding closed the necks of flexible bags and to strips of such closures which can be separated by breaking the connections between adjacent closures in the strip.

2. Description of the Prior Art

Multi-closure strips of the type shown in U.S. Pat. Nos. 3,164,249 and 3,164,250 are well known. These closures are generally made of flat, rigid plastic, and the closures are separated either manually or by machine from the strip by breaking the webs or material which interconnects adjacent closures in the strip. Occasionally, if the machines are not in proper operating condition, the webs or tabs which interconnect adjacent closures will not shear off both of the confronting edges of adjacent closures, leaving the then separated closure with jagged tabs protruding from its edges.

In addition to getting a clean break at the edge of each closure, it is also necessary that the webs, tabs, or other material which interconnects adjacent closures have sufficient strength in strip form that they will not prematurely break or separate during handling, either manually or in the automatic closure-applying machines.

SUMMARY OF THE INVENTION

It is an object of this invention to provide an improved multi-closure strip in which the closures are broken from the strip, consistently leaving a smooth edge with no protruding tabs.

It is another object of this invention to provide a multi-closure strip of flat, rigid plastic material which can be bent in a direction perpendicular to the plane of the strip or otherwise handled without premature separation of the closures from the strip.

Basically, these objects are obtained by providing the shape of each spaced web or interconnecting material between adjacent closures in the strip with a transversely enlarged central portion, with the juncture between the central portion and the edges of the adjacent closures being of reduced transverse width. This type of closure-connecting web will provide sufficient strength in handling, but when the closure is separated, particularly when separated by the application of a force transversely and in the plane of the closure, will break the webs cleanly at their juncture with each adjacent closure edge. The enlarged central portion is believed to provide greater resistance to deformation during the shearing or breaking operation, thus concentrating the stresses at the thinner juncture points of fracture at the closure edge to consistently break at the points of fracture. In the few cases where complete fracture does not occur, the webs are so weakened at the points of fracture that subsequent handling of the separated closure will cause any remaining webs to be knocked off the closure.

In the preferred form of the invention, the web is generally circular in configuration, having a radius arc approximately tangent to the opposed edges of both adjacent closures. The circular configuration appears to function better than other enlarged central portion configurations due to the additional effect of a camming action as the circular surface is rolled along each adjacent edge of the closure when broken by a tranverse shearing action.

BRIEF DESCRIPTION OF THE FIGURES OF THE DRAWINGS

FIG. 1 is a fragmentary plan view of a multi-closure strip embodying the principles of the invention.

FIG. 2 is a side elevation of the strip.

DETAILED DESCRIPTION OF THE DRAWING

The figures show a portion of a multi-closure strip of generally flat, rigid, plastic closures with only the two most end closures 10 and 11 of the strip being illustrated. Closure 10 is the last closure in the strip, with the closure to the left of closure 10 having been broken off. That is, closure 10 is the next closure to be broken from the strip. Each of the closures, as is well known, has a bag access opening 14 and a bag-holding central opening 16 for gripping a flexible material or bag, such as 18.

The closures are joined by webs or tabs 20. The tabs have a transversely enlarged central portion 22 and points of fracture or junctures 24 of reduced transverse width. In the preferred embodiment illustrated, the curvature of the enlarged central portion 22 is of a radius which is equidistantly positioned lengthwise between adjacent closures so that the edges of the adjacent closures are at a point of tangency with the radius of the circle. Thus, if the end closure 10 is broken off by a force F as the closure 11 is being stopped by an abutment 30, for example, the central portions 22 will tend to roll against the edges, acting like cams to push the central portions away from the edges of the closures. This assists in the separation of the webs at the points of fracture.

It should be understood, of course, that other configurations other than the circular configuration, such as ovals or rectangles, can be provided so long as the central portion is of an increased transverse width. These other configurations may or may not also achieve the additional camming action but will also break generally cleanly because of the stress concentration at the narrower widths.

While the preferred embodiment of the invention has been illustrated and described and while other alternatives have also been described, it should be understood that other variations will be apparent to one skilled in the art without departing from the principles herein. Accordingly, the invention is not to be limited to the exact configuration illustrated in the drawing.

I claim:

1. In a multi-closure strip wherein the closures each have a side-edge, bag-neck access opening joining a bag-neck confining aperture, said closures being joined together in such strip by webs spaced transverse to the length of the strip, the webs having a thickness in the length direction of the strip to space adjacent closures, and each said web having a transversely enlarged central portion relative to the lengthwise direction of the strip and transversely reduced points of fracture on each end of said central portion at the juncture of the closure and web whereby separation of the closures by breaking the points of fracture will leave a smooth edge at each closure.

2. The closure strip of claim 1, said enlarged central portion being generally circular about a center equidistantly spaced between points of tangency with adjacent closures in the strip.

3. The closure of claim 1 wherein said central portion is symmetrically located lengthwise of the strip.

4. In a multi-closure strip, said closures being joined together in such strip by webs spaced transverse to the length of the strip, the webs having a thickness in the length direction of the strip to space adjacent closures, and each said web having a transversely enlarged central portion relative to the lengthwise direction of the strip and transversely reduced points of fracture on each end of said central portion at the juncture of the closure and web whereby separation of the closures by breaking the points of fracture will leave a smooth edge at each closure.

* * * * *